US007451984B2

(12) United States Patent
Martin et al.

(10) Patent No.: US 7,451,984 B2
(45) Date of Patent: Nov. 18, 2008

(54) GIFT EXCHANGE GAME

(75) Inventors: Douglas A. Martin, Atlanta, GA (US); Danielle Hutchens, Atlanta, GA (US)

(73) Assignee: Zunker, Inc., Smyrna, GA (US)

( * ) Notice: Subject to any disclaimer, the term of this patent is extended or adjusted under 35 U.S.C. 154(b) by 26 days.

(21) Appl. No.: 11/563,886

(22) Filed: Nov. 28, 2006

(65) Prior Publication Data

US 2008/0122172 A1 May 29, 2008

(51) Int. Cl.
*A63F 9/04* (2006.01)

(52) U.S. Cl. ..... 273/146

(58) Field of Classification Search ..... None
See application file for complete search history.

(56) References Cited

U.S. PATENT DOCUMENTS 1,598,611 A 9/1926 Humphreys
4,678,191 A 7/1987 Mills et al.
4,743,031 A 5/1988 Lamle
4,856,784 A 8/1989 Magee
5,957,457 A * 9/1999 Shaw ..... 273/269
6,565,087 B1 * 5/2003 Taylor et al. ..... 273/142 R
6,729,619 B2 5/2004 Yu et al.
6,986,515 B2 * 1/2006 Hyduk ..... 273/304
2004/0164493 A1 * 8/2004 Hyduk ..... 273/292

OTHER PUBLICATIONS www.zianet.com/ebear/chinese.html—Chinese Gift Exchange.*
en.wikipedia.org/wiki/White_elephant_gift_exchange.*
Party Game Central—The internet's Largest party game Web site.*
Christmas Party Games! Enjoy the Games & Your Party!; pp. 1-7; http://www.partygameideas.com/christmas-games.htm.
Declaration.

* cited by examiner

*Primary Examiner*—Gene Kim
*Assistant Examiner*—Dolores Collins
(74) *Attorney, Agent, or Firm*—Alston & Bird, LLP

(57) ABSTRACT

Generally described, embodiments of the present invention provide novel methods for distributing gifts to participants of a game. In some embodiments, dice are used to determine which participants receive gifts. Some embodiments include provisions for allowing participants to retrieve gifts from other participants.

8 Claims, 3 Drawing Sheets

GIFT EXCHANGE GAME

BACKGROUND OF THE INVENTION

Games are often an integral part of parties or other type of gathering for friends, families and co-workers. Playing games often "breaks the ice" at parties and fosters new friendships and strengthens existing relationships. Another popular activity at parties is the exchange of gifts, which is especially true around various holidays. Over time, these two popular activities have been combined into a gift exchange game.

One known gift exchange game is often referred to as "white elephant." In this game, participants bring a wrapped gift to the party and place them in a pile. Then slips of paper numbered 1 through the total the number of participants are placed in a hat. Each participant selects a slip of paper from the hat. Then, the person holding the #1 slip selects one of the gifts from the pile and opens it. The person holding the #2 slip then has the option of selecting a wrapped gift or "stealing" the opened gift. This process continues until all of the participants have had a chance to select a wrapped gift or "steal" an unwrapped gift.

Although the "white elephant" game has been met with some success, party hosts are always looking for new ways to entertain their guests and game enthusiasts are likewise always looking for new games with more risk and potential reward. Thus, there is a need for new games for distributing or exchanging gifts that provide more excitement, risk and reward for the participants.

BRIEF SUMMARY OF THE INVENTION

To address needs in the art, some of which are discussed above, embodiments of the present invention provide a novel methods for distributing gifts game. In one embodiment, a method of exchanging gifts between a plurality of participants wherein each participant supplies wrapped gifts is provided. The game includes the steps of: accumulating the gifts at a central location; determining an order of play for the participants; allowing each participant to roll one or more dice according to the order determined and to retrieve one of the accumulated gifts if the roll result satisfies a predetermined criteria; and repeating until all gifts are retrieved.

In a further embodiment, a method of exchanging gifts between a plurality of participants wherein each participant supplies the same number of wrapped gifts. This method includes the steps of: accumulating the gifts at a central location; allowing each participant to roll one or more dice and to retrieve one of the accumulated gifts if the roll result satisfies a first predetermined criteria; repeating the previous step until all gifts are retrieved; removing the wrapping from the retrieved gifts; setting a timer to expire after a predetermined time period; allowing each participant to roll the one or more dice and to take one of the retrieved gifts from another of the plurality of participants if the roll result satisfies a second predetermined criteria; repeating the previous step until the predetermined time period expires.

In another embodiment, a method of distributing a plurality of gifts among a plurality of participants is provided. This method includes the steps of: accumulating a plurality of gifts at a central location; allowing each participant to roll one or more dice and to retrieve one of the accumulated gifts if the roll result satisfies a first predetermined criteria; repeating the previous step until all gifts are retrieved; removing the wrapping from the retrieved gifts; setting a timer to expire after a predetermined time period; allowing each participant to roll the one or more dice and to take one of the retrieved gifts from another of the plurality of participants if the roll result satisfies a second predetermined criteria; and repeating the previous step until the predetermined time period expires.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Generally described, embodiments of the present invention provide novel methods for distributing gifts to participants of a game. In some embodiments, dice are used to determine which participants receive gifts. Some embodiments include provisions for allowing participants to retrieve gifts from other participants.

Figure 1:
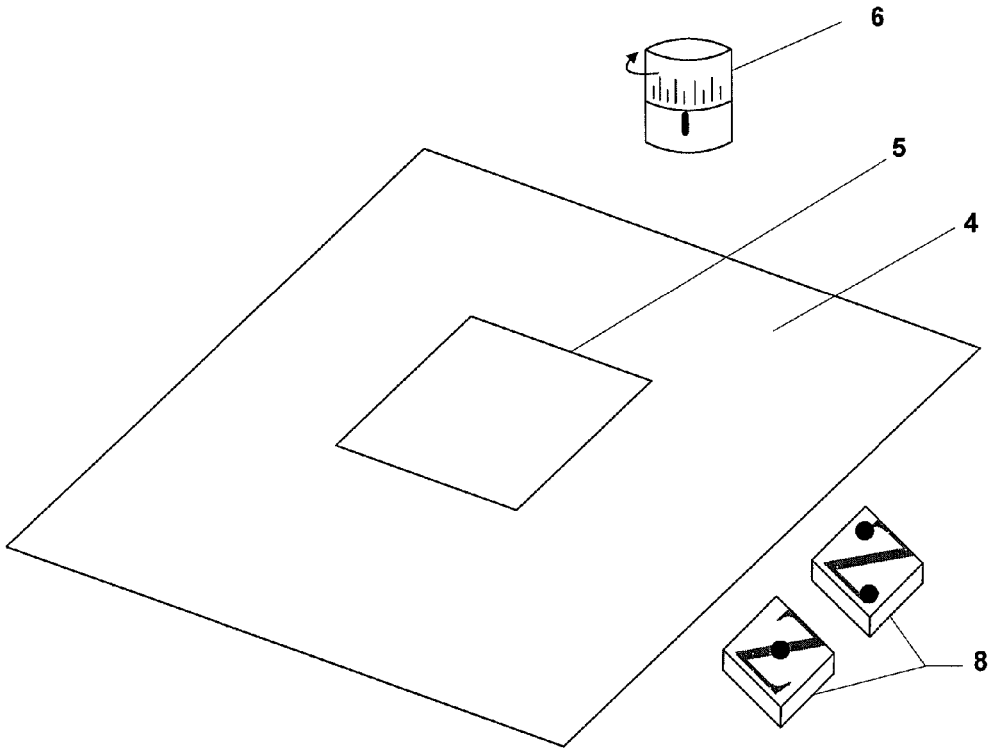
FIG. 1 is a schematic diagram illustrating components of an embodiment of the gift exchange game.

FIG. 1 provides an illustration of a gift exchange game 2 in accordance with an embodiment of the present invention. The gift exchange game 2 includes a game playing mat 4 that may be placed on a table or other surface. The mat includes indicia 5 showing where the gifts are to be placed. Also included is a time measurement device or timer 6. The device 6 may be a digital or mechanical device that provides an audible or visual indication when a desired time period expires. In one embodiment, the time measurement device 6 may be set to expire at any desired time period. Alternatively, the time measurement device 6 may be designed to expire after a specific time period such as sand in an hour-glass.

The gift exchange game 2 also includes one or more dice 8. In the illustrated embodiment, two standard six-sided dice are shown. However, the term "dice" as used herein should be interpreted broadly to include any multi-sided object having different indicia on each side. For example, the term dice is broad enough to encompass objects having any polyhedral shape (e.g., 5 sides, 10 sides, 12 sides). In a further embodiment, a random number generator may be used in place of the dice.

Figure 2:
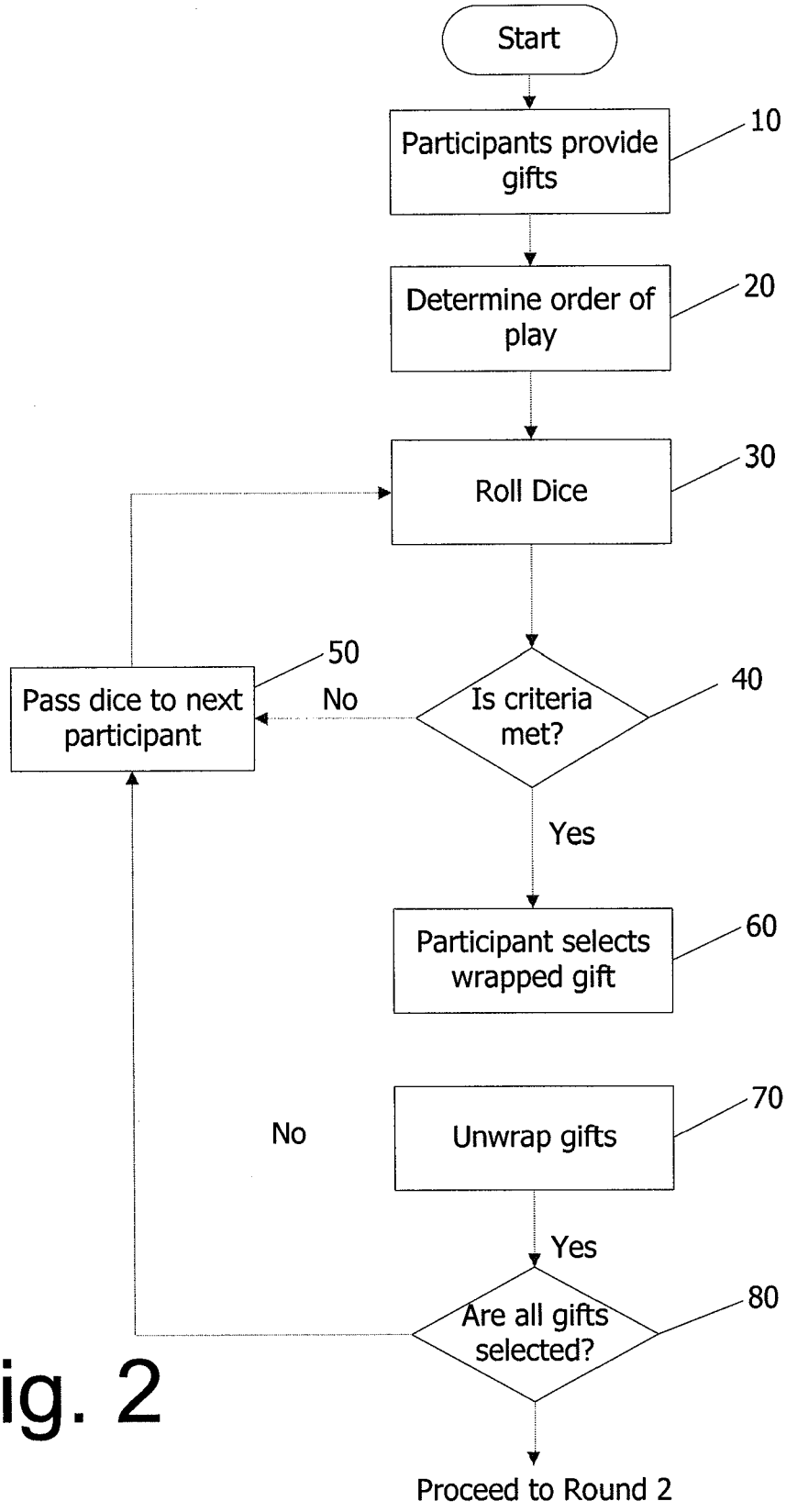
FIG. 2 is a flow diagram illustrating a first round of a gift exchange game in accordance with an embodiment of the present invention.

FIG. 2 provides a flow diagram illustrating steps for the first round of gift exchange game in accordance with an embodiment of the present invention. The game begins at Step 10 where each gift exchange participant provides one or more wrapped gifts. Alternatively, a plurality of gifts may be provided by one or more of the participants or by other individuals.

The gifts may be of similar value and may be of a similar theme. Alternatively, the gifts may be of different value with some being "gag" type gifts. The wrapped gifts are accumulated in a central location such as in a pile on the floor or table, and the participants may gather around the pile of gifts in a circle to facilitate game play.

After accumulating the gifts at Step 10, the process continues to Step 20 where the order of play is determined. This could be based on the age of the participants (e.g., youngest to oldest), participants height or any other method including random order. In one embodiment, a participant is selected to take the first turn (e.g., the guest of honor) and play continues to other participants in a clockwise or counterclockwise fashion.

At Step 30, a participant rolls one or more dice. For ease of understanding, the following paragraphs will describe the game assuming the use of two well known six sided (i.e. cube shaped) dice where each die has indicia on its sides indicating the numbers one to six; however, as will be understood by those of skill in the art, any type or number of dice may be used in connection with embodiments of the present invention.

At Step 40, the result of the participant's roll of the dice is compared against predetermined criteria. Assuming two well know six sided dice are rolled, the criteria may be that the sum of the dots on the top surface of dice after they come to a rest equals a predetermined number such as seven. Alternatively, the roll result may be compared against two predetermined number such as seven and eleven. Other criteria may also be used such as the indicia on the top surfaces of the two dice are the same (e.g., "doubles") or the sum of the dots is an even or odd number. It should be understood that any criteria may be used in connection with the embodiments of the present invention including any combination of the criteria discussed above.

If the roll result does not satisfy the predetermined criteria, the process continues to Step 50 where the dice are passed to the next participant according to the earlier determined order. The process then returns to Step 30 where the new participant rolls the dice.

If the roll result satisfies the criteria, the process continues to Step 60 where the participant selects a wrapped gift from the accumulated gifts. At Step 70, the participant unwraps the selected gift. In an alternative embodiment, the participants may wait to unwrap their retrieved gifts until all of the accumulated gifts are retrieved.

In an alternative embodiment, the roll result may be compared against different criteria resulting in different actions. For example, a first criterion may be that the roll result is compared against predetermined numbers and if this criterion is met, the participant is allowed to select a wrapped gift. A second criterion may be that the roll results in doubles, in which case the participant may be, for example, allowed to select a gift and roll again. As will be understood by those of skill in the art, any number of different criteria may be used and any desired action may be defined as a result of satisfying the different criteria such as rolling again or losing a turn.

After the participant unwraps a gift at Step 70, the process continues to Step 80 were a determination is made as to whether any wrapped gifts remain. If there are gifts remaining in the accumulated pile, the dice are passed to the next participant at Step 50.

If the last gift in the pile is selected at Step 60 as determined at Step 80, the first round of the game ends. It should be understood that it is possible for some participants to have multiple gifts while other participants do not have a gift.

Figure 3:
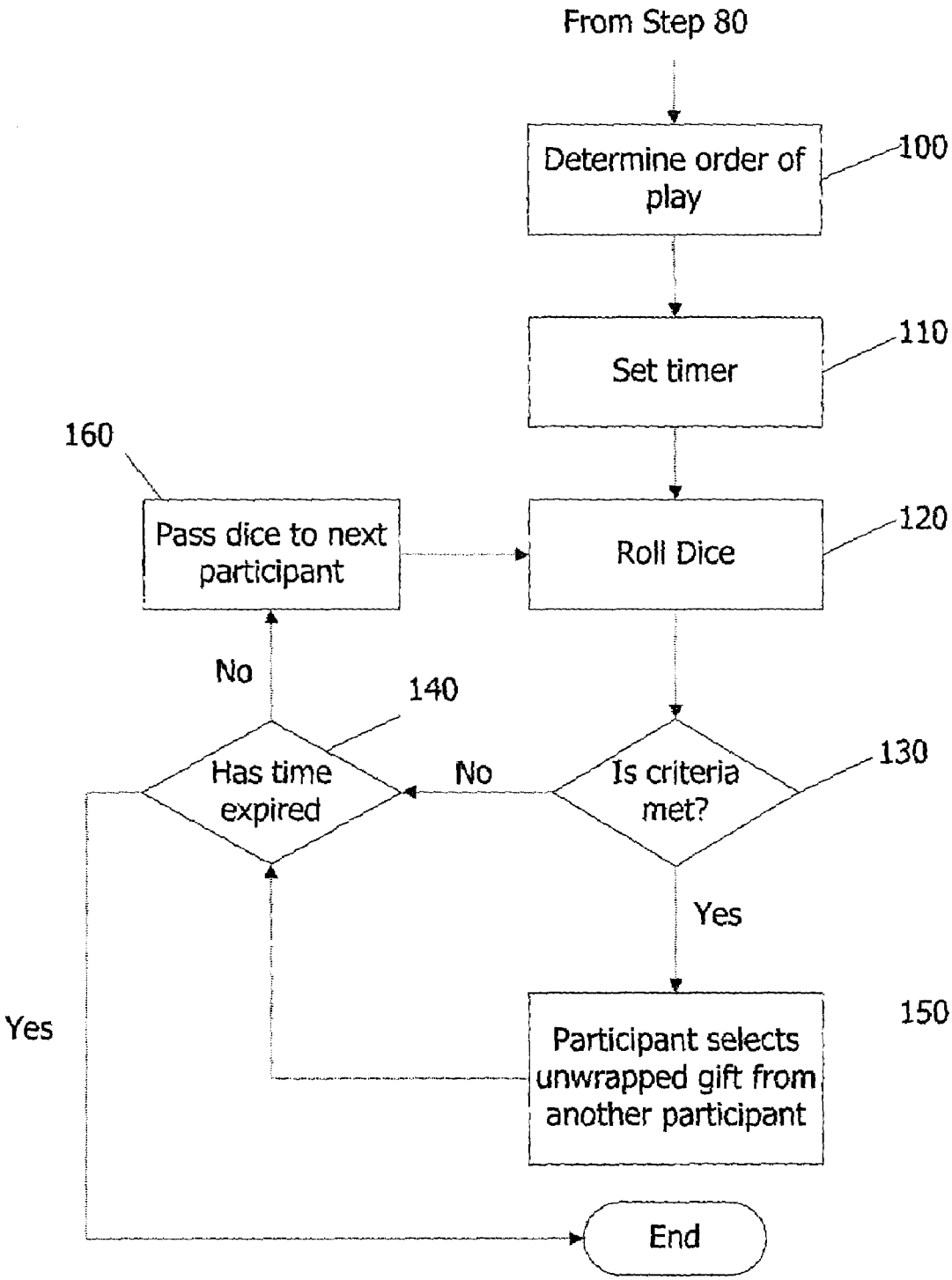
FIG. 3 is a flow diagram illustrating a second round of a gift exchange game in accordance with an embodiment of the present invention.

In one embodiment, the game ends at Step 80. Alternatively, the game may continue to a second round as generally illustrated in the flow diagram provided in FIG. 3. This round begins at Step 100 with the determination of the order of play for the second round. In one embodiment, the last participant of round one becomes the first participant in round two and the play continues in the opposite order from the first round. Alternatively, the play may continue in the same order as the previous round or new criteria may be used to determine the order. For example, the order of play may be determined by the number of gifts each participant acquired in the first round. In one embodiment, the participant with the least number of gifts goes first with the participant with the next least number of gifts goes second and so on.

After determining the order at Step 100, the game continues at Step 110 with the setting of a timer to expire at the end of a predetermine period of time. In one embodiment, the time period is a function of the number of participants. For example, two minutes may be added to the timer for each participant (e.g., 10 participants*2 minutes=20 minutes). In an alternative embodiment, the timer may be set to a time value independent of the number of participants. It should be understood that any type of device capable of measuring time may be used in connection with the present invention.

Continuing to Step 120, the first participant, as determined at Step 100, rolls the dice. As with the discussion of round one, any type or number of dice may be used in connection with the second round embodiments of the present invention; however, the following paragraphs will assume the use of two six sided dice.

After rolling the dice, the result is compared against predetermined criteria at Step 130. It should be understood that this criteria may be the same or different from the criteria used in connection with round one. For this example, we will assume that the criteria is that the sum of the dots or numbers on the upper face of the two six sided dice when they come to rest after a roll equals a one or more predetermined numbers such as seven and/or eleven and/or the number on the dice are the same (e.g., "doubles").

If the criteria are not met, the process continues to Step 140 where a determination is made as to whether the predetermined time period has expired. If the predetermined time period has not expired, the dice is passed the next participant and the process returns to Step 120 with the next participant rolling the dice.

If the criteria are met, the rolling participant can select an unwrapped gift from one of the other participants at Step 150. As with the first round, a participant's roll may be compared against more than one criteria where satisfying the different criteria may result in different actions such as rolling again, or losing a turn.

In one embodiment, the participant must utter a predetermined word or phrase before selecting a gift from another participant at Step 150 such as "Zunker." Failing to utter the predetermined word or phrase may result in the loss of a turn.

The process continues to Step 140 where the timer is checked to determine if the predetermined time has expired. If the time has not expired, the dice is passed to the next participate at Step 160.

The game ends when the predetermined time period has expired at Step 140. In one embodiment, a participant is allowed to complete his or her roll even if the predetermined time period has expired as generally illustrated in FIG. 2. Alternatively, game play may stop immediately when the timer indicates the predetermined time has expired, even in the middle of a turn.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of exchanging gifts between a plurality of participants wherein each participant supplies one or more wrapped gifts, said method comprising the steps of:

a. accumulating said gifts at a central location;

b. allowing each participant in turn to roll one or more dice and to retrieve one of said accumulated gifts if the roll result satisfies a first predetermined criteria;

c. repeating step b until all gifts are retrieved;

d. removing said wrapping from said retrieved gifts;

e. after removing said wrapping, setting a timer to expire after a predetermined time period;

f. allowing each participant to roll said one or more dice and to take one of said retrieved gifts from another of said plurality of participants if the roll result satisfies a second predetermined criteria; and g. repeating said step f until said predetermined time period expires.

2. The method for exchanging gifts of claim 1, wherein said participant rolls two dice during the retrieving from the accumulated gifts step.

3. The method for exchanging gifts of claim 2, wherein said first predetermined criteria comprises a number.

4. The method for exchanging gifts of claim 1, further comprising the step of allowing a participant to take an additional turn if said roll result satisfies a third predetermined criteria.

5. The method for exchanging gifts of claim 1, further comprising the step of uttering a predetermined word or phrase before taking one of said retrieved gifts from another of said plurality of participants.

6. The method for exchanging gifts of claim 1, wherein said predetermined time period is a function of the number of participants.

7. The method of exchanging gifts of claim 1, wherein said first predetermined criteria is the same as said second predetermined criteria.

8. A method of distributing a plurality of gifts among a plurality of participants, said method comprising the steps of:

a. accumulating a plurality of gifts at a central location;

b. determining an order of play for said participants;

c. allowing each participant to roll one or more dice according to said order determined in step b and to retrieve one of said accumulated gifts if the roll result satisfies a first predetermined criteria;

d. repeating step b until all gifts are retrieved;

e. removing said wrapping from said retrieved gifts;

f. after removing said wrapping, setting a timer to expire after a predetermined time period;

g. allowing each participant to roll said one or more dice and to take one of said retrieved gifts from another of said plurality of participants if the roll result satisfies a second predetermined criteria; and h. repeating said step g until said predetermined time period expires.

* * * * *